United States Patent [19]

Nishiyama et al.

[11] Patent Number: 4,996,960

[45] Date of Patent: Mar. 5, 1991

[54] AIR-FUEL RATIO CONTROL SYSTEM FOR AN INTERNAL COMBUSTION ENGINE

[75] Inventors: Ryoji Nishiyama; Satoru Ohkubo, both of Hyogo, Japan

[73] Assignee: Mitsubishi Denki Kabushiki Kaisha, Tokyo, Japan

[21] Appl. No.: 481,254

[22] Filed: Feb. 20, 1990

[30] Foreign Application Priority Data

Feb. 20, 1989 [JP] Japan ..... 1-40639

[51] Int. Cl.[5] ..... F02B 41/10; F02B 41/12; F02B 41/14

[52] U.S. Cl. ..... 123/435; 123/492; 123/493; 123/494

[58] Field of Search ..... 123/435, 478, 494, 492, 123/493; 73/117.3, 118.2

[56] References Cited

U.S. PATENT DOCUMENTS 4,913,118 4/1990 Watanabe ..... 123/435

FOREIGN PATENT DOCUMENTS 103965 6/1984 Japan ..... 123/435
221433 12/1984 Japan .
55336 3/1986 Japan .
75325 4/1988 Japan ..... 123/435
75326 4/1988 Japan ..... 123/435

*Primary Examiner*—Tony M. Argenbright
*Attorney, Agent, or Firm*—Sughrue, Mion, Zinn, Macpeak and Seas

[57] ABSTRACT

An air-fuel ratio control system for an internal combustion engine is disclosed. A basic fuel injection quantity is determined by using a cylinder pressure at a predetermined crank angle, and a signal provided by an intake air temperature sensor as parameters. A compensation fuel injection quantity for an accelerating mode or a decelerating mode is determined on the basis of a predetermined cylinder pressure variation corresponding to the variation of the output of a throttle opening sensor and an engine speed. The air-fuel ratio control system does not need an expensive air flow meter.

2 Claims, 6 Drawing Sheets

AIR-FUEL RATIO CONTROL SYSTEM FOR AN INTERNAL COMBUSTION ENGINE

BACKGROUND OF THE INVENTION

This invention relates to an air-fuel ratio control system for an internal combustion engine (hereinafter, referred to simply as "engine"), for controlling the air-fuel ratio of air-fuel mixture supplied to the engine.

FIG. 4 shows a fuel-air ratio control system for an engine, disclosed in Japanese Public Disclosure (Kokai) Nos. 59-221433 and 61-55336. Shown in FIG. 4 are an air cleaner 1, an air flow meter 2 for measuring intake air flow, a throttle valve 3, an intake manifold 4, a cylinder 5 of the engine, a coolant temperature sensor 6 for detecting the temperature of the cooling water, a crank angle sensor 7, an exhaust manifold 8, an exhaust gas sensor 9 for detecting the respective concentrations of the components of the exhaust gas, such as the oxygen concentration, a fuel injection valve 10, an ignition plug 11, a cylinder pressure sensor 13 for detecting the pressure in the combustion chamber of the engine and a control unit 15.

The crank angle sensor 7 generates reference angle pulses respectively at reference crank angles, namely, every 180° rotation of the crankshaft for a four cylinder engine or every 120° rotation of the crankshaft for a six-cylinder engine, and a unit angle pulse every unit angle rotation of the crankshaft, 1°. The control unit 15 counts the unit angle pulses after the reception of the reference angle pulse to detect the crank angle at every moment. The engine speed can be detected through the measurement of the frequency or period of the unit angle pulses.

The crank angle sensor 7 of the fuel-air ratio control system shown in FIG. 4 is provided in a distributor. The control unit 15 comprises a microcomputer comprising a CPU, ROMs, RAMs, an I/O interface and the like. The control unit 15 processes the output signals of the air flow meter 2, the coolant temperature sensor 6, the crank angle sensor 7, the cylinder pressure sensor 13 and the like, and provides a fuel injection signal determined on the basis of the result of signal processing to control the fuel injection valve 10.

Shown, by way of example, in FIGS. 5(A) and 5(B) is the cylinder pressure sensor 13 comprising an annular piezoelectric crystal element 13A, an annular negative electrode 13B and a positive electrode 13C. FIG. 6 shows the position of the cylinder pressure censor 13 on the engine. The cylinder pressure sensor 13 is fastened to a cylinder head 14 with the ignition plug 11. The cylinder pressure sensor 13 generates an output signal proportional to the cylinder pressure.

This control unit 15 has a CPU which executes a control program as shown in FIG. 7 stored in a ROM at predetermined time intervals. Referring to FIG. 7, engine speed N and intake air flow Q are determined in step P1 from an output signal S3 of the crank angle sensor 7 and an output signal S1 of the air flow meter 2 respectively. In step P2, basic fuel injection quantity is calculated from engine speed N and intake air flow Q by using a formula:

$$T_p = K(Q/N)$$

where $T_p$ is basic fuel injection quantity, K is a constant, Q is intake air flow and N is engine speed. In step P3, crank angle is determined from the output signal of the crank angle sensor 7. In step P4, a query is made to see if the determined crank angle corresponds to the bottom dead center (abbreviated to "BDC") of the crank of the cylinder in the suction stroke. Step P6 is executed when the response in step P4 is negative. When the response in step P4 is affirmative, step P5 is executed t store an output signal S6 of the cylinder pressure sensor 13 as cylinder pressure $P_t$ with the crank at the BDC in the suction stroke.

In step P6, a query is made to see if the crank angle corresponds to a predetermined crank angle after top dead center (abbreviated to "ATDC") in the compression stroke. The value of the predetermined crank angle is dependent on the ratio between the crank throw and the length of the crank connecting rod of the engine, and is, for example, 15° in this example. When the response in step P6 is negative, the program returns to step P3 to repeat steps P3 through P6 until the response in step P6 becomes affirmative. When the response in step P6 is affirmative, the output signal S6 of the cylinder pressure sensor 13 is stored in step P7 as cylinder pressure $P_m$ at a crank angle 15° ATDC.

Then, in step P8, the pressure ratio $P_m/P_t$ is calculated and the calculated value of the pressure ration $P_m/P_t$ is stored. In step P9, the pressure ratio $P_mP_t$ is added to the cumulative sum $\Sigma(P_m/P_t)$ of the pressure ratios calculated in the preceding control cycle to obtain the cumulative sum $\Sigma(P_m/P_t)$ of a predetermined number of pressure ratios $P_m/P_t$. In step P10, the new cumulative sum $\Sigma(P_m/P_t)$ and a cumulative sum $\Sigma(P_m/P_t)$ used in the preceding fuel injection control cycle are compared, and an air-fuel ratio compensation factor $\alpha$ is calculated on the basis of the comparison. In step P11, a compensated fuel injection quantity $T_i$ is determined by using an expression:

$$T_i = T_p \times (1 + F_t + KMR/100) + \alpha + T_s$$

where $F_t$ is a temperature compensation factor determined from the output signal S2 of the coolant temperature sensor 6, $T_s$ is a battery voltage compensation factor, and KMR is a high-load compensation factor obtained through table look-up using the engine speed N and the basic fuel injection quantity $T_p$. The initial value of the air-fuel ratio compensation factor $\alpha$ is reset at "1"at the time of starting the engine.

Finally in step P12, the fuel injection valve 10 is operated by a signal S5 corresponding to the calculated, compensated fuel injection quantity $T_i$.

Thus, according to the control program shown in FIG. 7, the air-fuel ratio is controlled in a feedback control mode by detecting the cylinder pressure $P_m$ at a crank angle at which the cylinder pressure is expected to reach a maximum, normalizing the cylinder pressure $P_m$ by the cylinder pressure $P_t$ at the BDC in the suction stroke, which is proportional to the load, an compensating the fuel injection quantity so that the value of the cumulative sum of a predetermined number of normalized values $P_m/P_t$ reaches a maximum.

This air-fuel ratio control system, however, needs an expensive air flow meter and a still more expensive cylinder pressure sensor to measure intake air flow Q, which represents the load on the engine, and engine speed N to determine basic fuel injection quantity on the basis of the ratio Q/N. Furthermore, a comparatively long period of time is necessary for detecting cylinder pressure a predetermined times and summing the values of cylinder pressures delays the response of the air-fuel ratio control system during acceleration of the engine thereby causing deterioration in the performance of the engine.

SUMMARY OF THE INVENTION

Accordingly, it is a primary object of the present invention to provide an air-fuel ratio control system for an engine, capable of responding in a sufficiently short response time to the transient operation of the engine for air-fuel ratio control without requiring any air flow meter.

In one aspect of the present invention, an air-fuel ratio control system comprises arithmetic means for computing a basic fuel injection quantity $T_p$ by using a cylinder pressure and an intake air temperature as principal parameters, computing at least a compensation fuel injection quantity $\Delta T_p$ for either acceleration or deceleration on the basis of a cylinder pressure variation predetermined as a function of throttle opening variation and engine speed, and computing the value of $T_p+\Delta T_p$.

The air-fuel ratio control system in accordance with the present invention determines a basis fuel injection quantity $T_p$ on the basis of charging efficiency calculated by using the cylinder pressure and the intake air temperature because the cylinder pressure at a predetermined crank angle during a compression stroke of the engine corresponds to a charging efficiency of the engine, estimates a charging efficiency variation on the basis of the cylinder pressure variation estimated from the cylinder pressure determined beforehand on the basis of throttle opening variation and engine speed, computes a compensation fuel injection quantity $\Delta T_p$ on the basis of the estimated charging efficiency, and determines a compensated fuel injection quantity $T_{p+\Delta Tp}$.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENT

Figure 1:
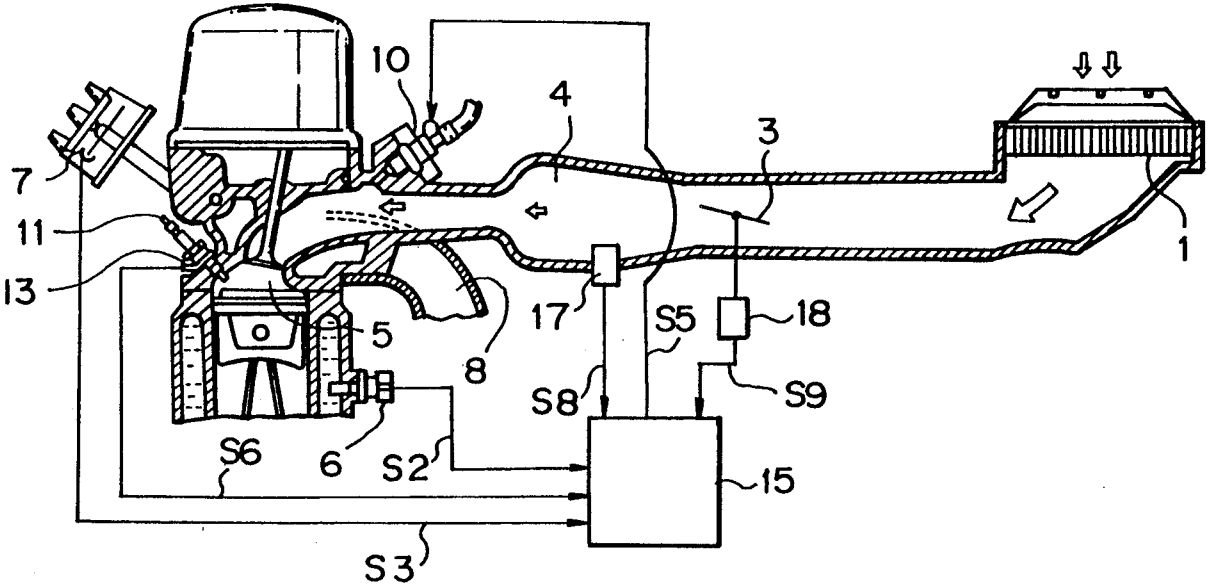
FIG. 1 is a schematic view of an air-fuel ratio control system for an engine, in a preferred embodiment according to the present invention.

An air-fuel ratio control system embodying the present invention will be described with reference to the accompanying drawings, in which parts like or corresponding to those previously described with reference to the conventional air-fuel ratio control system are denoted by the same reference characters and the description thereof will be omitted.

Referring to FIG. 1, an air-fuel ratio control system in accordance with the present invention comprises a coolant temperature sensor 6, a crank angle sensor 7, a cylinder pressure sensor 13, a control unit 15, an intake air temperature sensor 17 for detecting a temperature of intake air flowing through an intake manifold 4 and a throttle opening sensor 18 for detecting the opening degree of a throttle valve 3, and is not provided with any air flow meter. The control unit receives a coolant temperature signal S2 from the coolant temperature sensor 6, a crank angle signal S3 from the crank angle sensor 7, a pressure signal S6 from the cylinder pressure sensor 13, an intake air temperature signal S8 from the intake air temperature sensor 17 and a throttle opening signal S9 from the throttle opening sensor 18, and processes those input signals to provide a fuel injection signal S5 to control a fuel injection valve 10.

Figure 2:
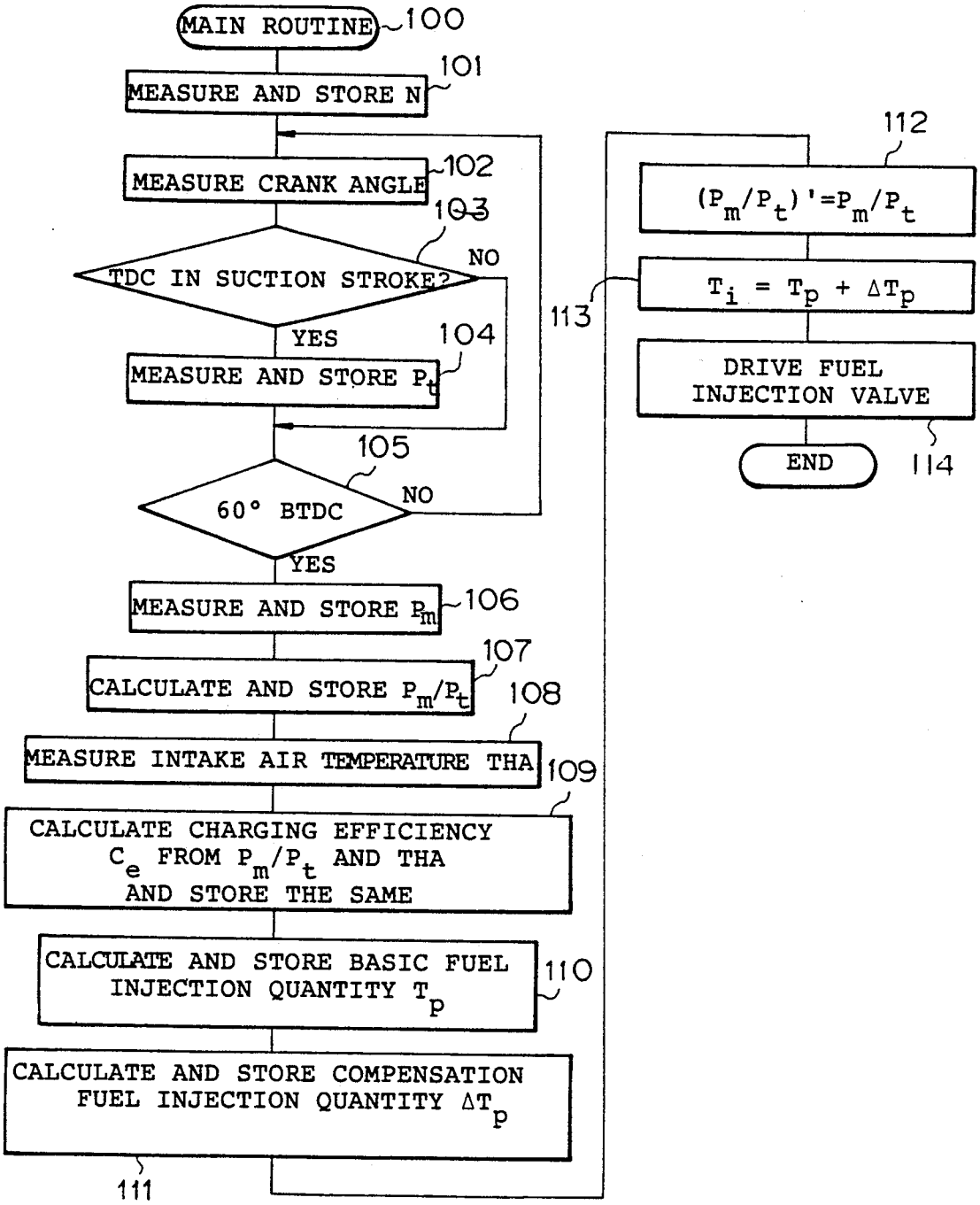
FIGS. 2 and 3 are flow charts of a control program to be executed by the air-fuel ratio control system of FIG. 1.
Figure 3:
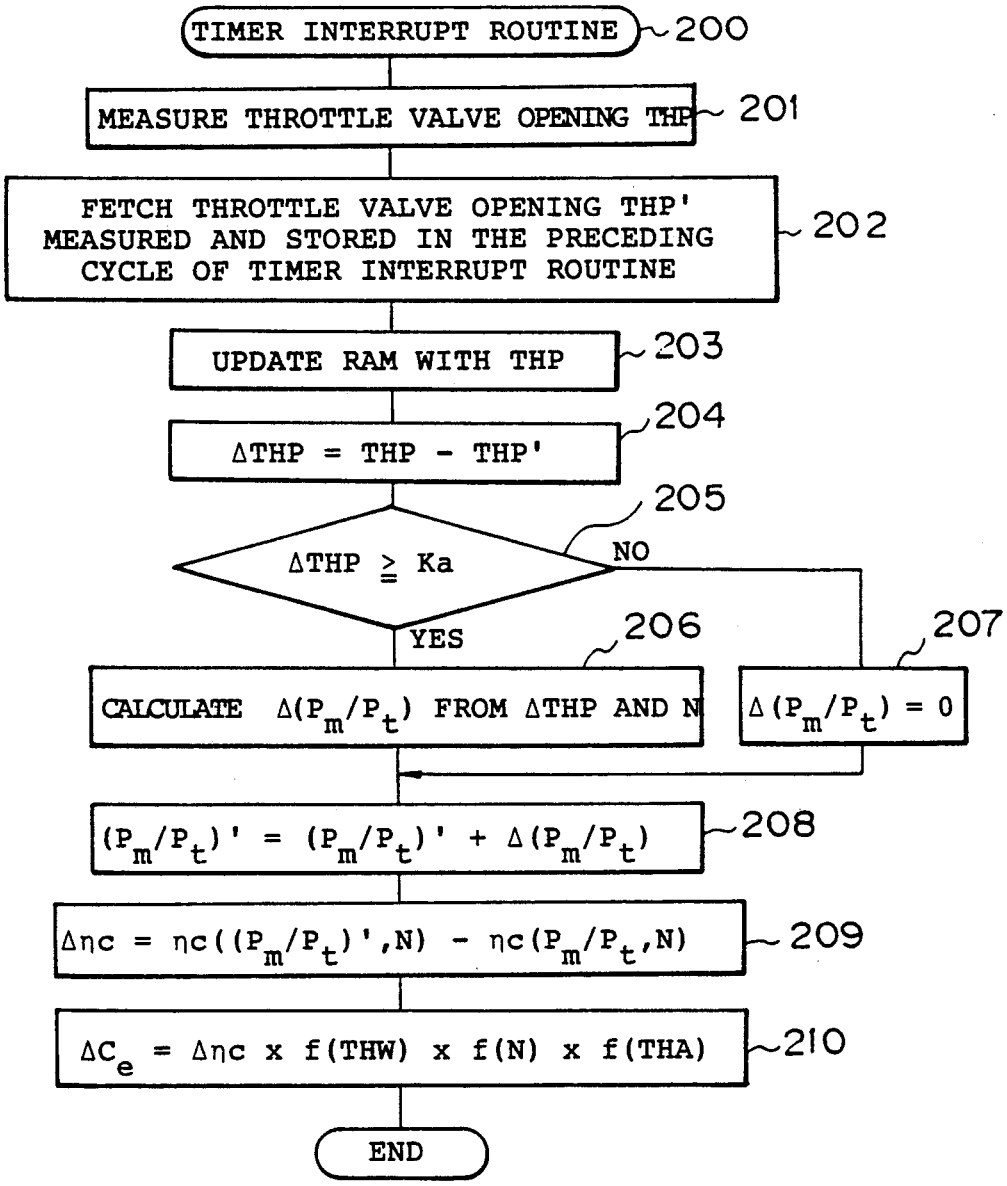
Figure 4:
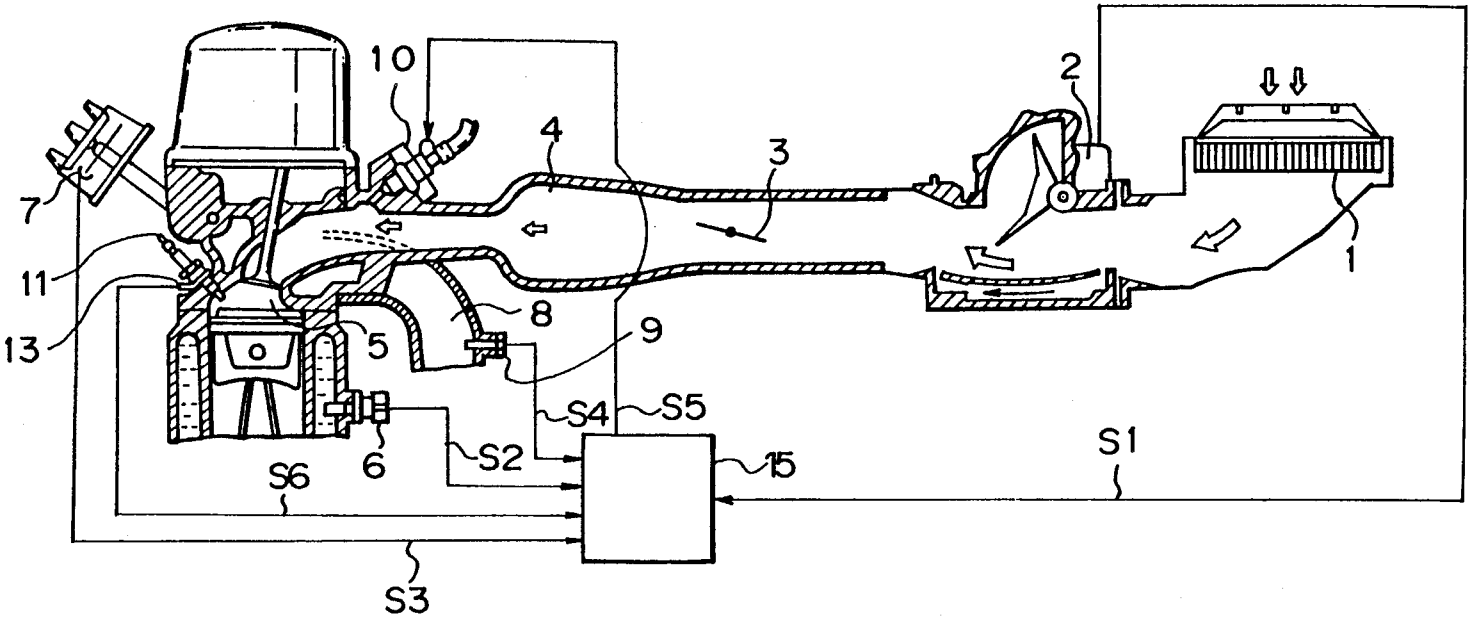
Fig. 4 PRIOR ART
FIG. 4 is a schematic view of a conventional air-fuel ratio control system for an engine.
Figure 5:
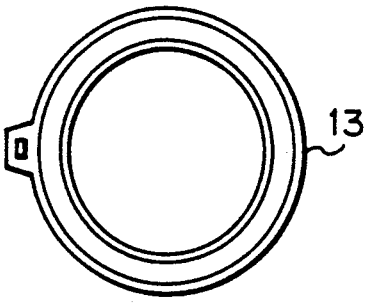
FIGS. 5(A), 5(B) and 6 are a plan view and sectional views of a cylinder pressure sensor employed in the conventional air-fuel ratio control system of FIG. 4.
Figure 5:
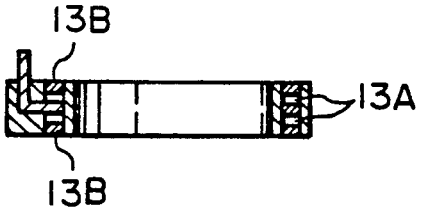
Figure 6:
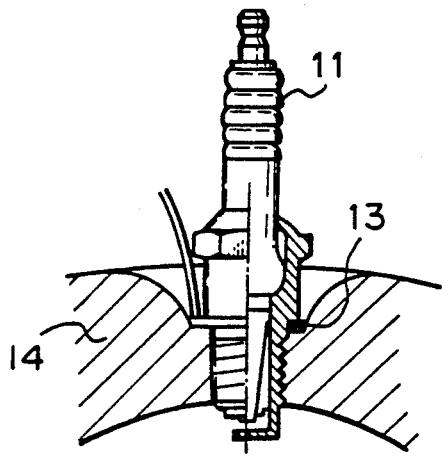
Figure 7:
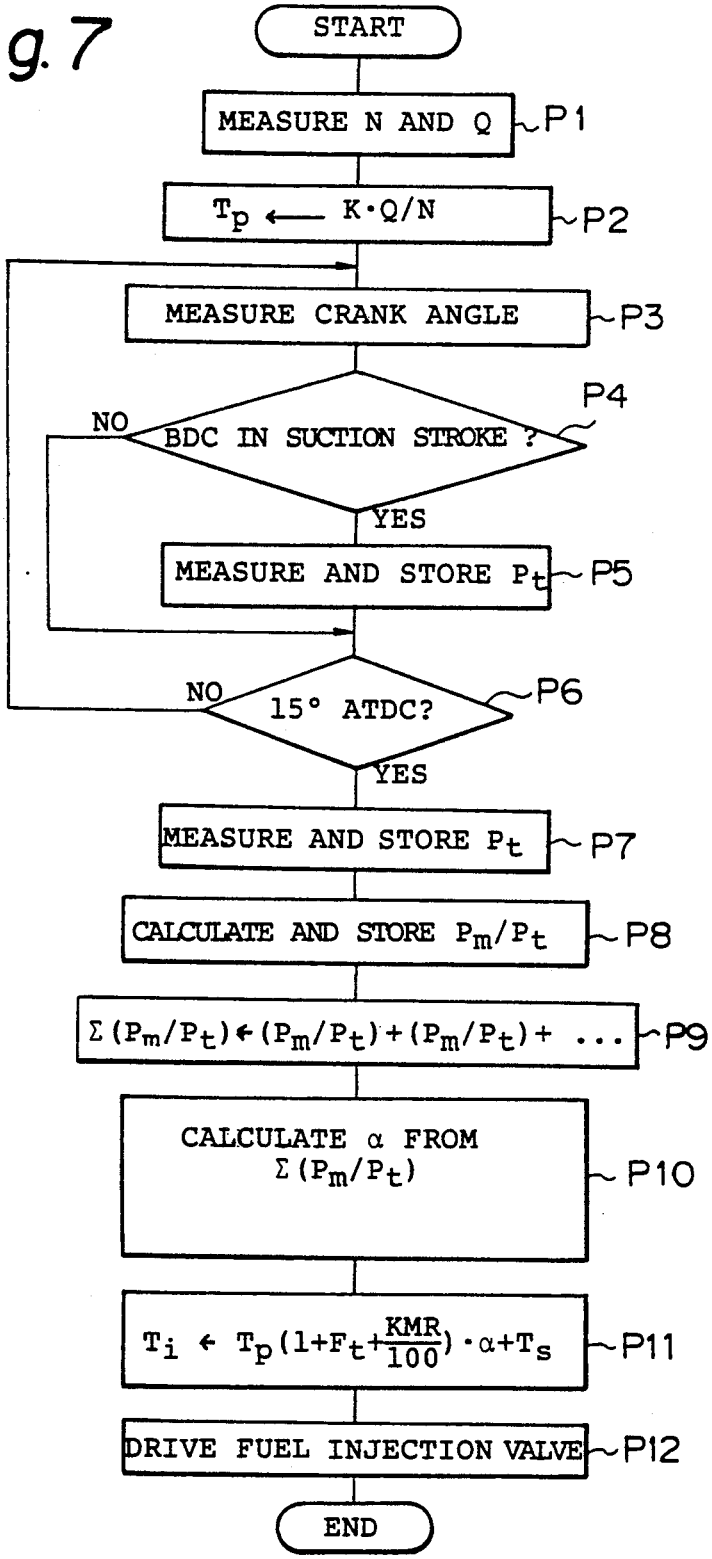
FIG. 7 is a flow chart of a control program to be executed by the conventional air-fuel ratio control system of FIG. 4.

A main routine 100 shown in FIG. 2 and a timer interrupt routine 200 shown in FIG. 3 are stored in a ROM included in the control unit 15. The control unit 15 has a microprocessor which executes the main routine 100, and the timer interrupt routine 200 at predetermined intervals during the execution of the main routine 100.

The operation of the control unit 15 to execute the main routine 100 and the timer interrupt routine 200 will be described hereinafter.

Referring to FIG. 2, an engine speed N represented by an output signal S3 of the crank angle sensor 7 is stored in step 101. In step 102, a crank angle corresponding to an output signal of the crank angle sensor 7 is stored. In step 103, a query is made to see if the crank angle corresponds to the TDC in the suction stroke. When the response in step 103 is negative, the routine jumps to step 105, and when affirmative, the routine goes to step 104 to store a pressure signal S6 provided by the cylinder pressure sensor 13 as a cylinder pressure $P_t$ at the TDC in the suction stroke.

In step 105, a query is made to see if the crank angle is, for example, 60° before the top dead center (abbreviated to "60° BTDC"). Before a crank angle of 60° BTDC, the poly-tropic index is substantially constant and the cylinder pressure varies according to the intake air flow. When the response in step 105 is negative, the routine returns to step 102 to repeat the foregoing steps, and when affirmative, step 106 is executed to store a pressure signal S6 provided by the cylinder pressure sensor 13 ad a cylinder pressure $P_m$ at a crank angle of 60° BTDC in the compression stroke.

In step 107, the ratio $P_m/P_t$ is calculated and the result of calculation is stored. In step 108, an output signal of the intake air temperature sensor 17 is stored as an intake air temperature THA. In step 109, a factor $\eta_c$ for calculating a predetermined air-fuel ratio corresponding to the cylinder pressure ratio $P_m/P_t$ and the engine speed N is fetched from the ROM by mapping, and a charging efficiency $C_e$ is calculated by using the factor $\eta_n$, the intake air temperature THA and the following formula, and the calculated charging efficiency $C_e$ is stored.

$$C_e=\eta_c\times(273+25)/(273+\mathrm{THA})$$

In step 110, a basic fuel injection quantity $T_p$ is calculated by using a formula:

$$T_p=K_i\cdot C_e(1+F_t)+T_s$$

where $T_s$ is a battery voltage compensation factor, $F_t$ is a compensation factor based on the coolant temperature determined from the output signal S2 of the coolant temperature sensor 6 and the like, and $K_i$ is a conversion factor for converting the charging efficiency defined by the cylinder pressure and the intake air temperature into a corresponding fuel injection quantity.

Subsequently, in step 111, a compensation fuel injection quantity $\Delta T_p = K_i \cdot \Delta C_e$ is calculated by using a charging efficiency variation $\Delta C_e$ calculated and stored through the execution of the timer interrupt routine 200 shown in FIG. 3, and the result of calculation is stored. In step 112, the cylinder pressure ration $P_m/P_t$ calculated and stored through the execution of the main routine in this control cycle is stored int the RAM as a predictive cylinder pressure ratio $(P_{m/Pt})'$. In step 113, $T_{p+\Delta Tp}$ is calculated to determine a compensated fuel injection quantity $T_i$. Finally, in step 114, a signal S5 representing the calculated, compensated fuel injection quantity $T_i$ is provided to drive the fuel injection valve 10.

The timer interrupt routine 200 will be described hereinafter with reference to FIG. 3.

In step 201, the latest throttle opening THP represented by a throttle opening signal S9 is stored in the RAM. In step 202, a throttle opening THP' stored in the preceding cycle of the timer interrupt routine is fetched from the RAM. In step 203, the throttle opening THP' is replaced with the latest throttle opening THP and the latest throttle opening THP is stored in the RAM. In step 204, a throttle opening variation in a set time period $\Delta THP = THP - THP'$ is calculated.

In step 205, the throttle opening variation ΔTHP is compared with a predetermined criterion $K_a$ an accelerating mode to see if the throttle opening variation ΔTHP is not less than the criterion $K_a$. When the response in step 205 is affirmative, step 206 is executed to map a cylinder pressure variation $\Delta(P_m/P_t)$ corresponding to the engine speed N and the throttle opening variation ΔTHP from the ROM, and when negative, the cylinder pressure variation $\Delta(P_{m/Pt})$ is supposed to be zero in step 207 and the routine goes to step 208. In step 208, the predictive cylinder pressure ratio $(P_m/P_t)' = (P_m/P_t)' + \Delta(P_m/P_t)$ is calculated. The predictive cylinder pressure ration $(P_m/P_t)'$ is replaced with the latest predictive cylinder pressure ratio every cycle of the main routine.

In step 209, a differential factor $\Delta\eta_c = \eta_c((P_m/P_t)', N) - \eta_c({}_mP_t, N)$, namely, the remainder of substraction of the factor $\eta_c$ corresponding to the cylinder pressure ratio $P_m/P_t$ and the engine speed N determined in the preceding cycle of the main routine and stored in the RAM from the $\eta_c$ corresponding to the predictive cylinder pressure ratio $(P_m/P_t)'$, is determined by mapping. Then, in step 210, the differential factor $\Delta\eta_c$ is multiplied by predetermined compensation factors f(THW), f(N) and f(THA) respectively corresponding to the coolant temperature THW, the engine speed N and the intake air temperature THA to obtain a predictive charging efficiency variation $\Delta C_e$, and then the timer interrupt routine is ended.

Thus, the timer interrupt routine detects acceleration during the cycle of the main routine, predicts the cylinder pressure ratio, and calculates the charging efficiency variation $\Delta C_e$ by using the predictive cylinder pressure ratio $(P_m/P_t)'$. Accordingly, an incremental accelerating fuel injection quantity $\Delta T_p$, similarly to the basic fuel injection quantity $T_p$, can be calculated by using the charging efficiency $C_e$.

The pressure difference $P_m - P_t$ (for example, the difference between cylinder pressures respectively at two crank angles, such as α° and 200° BTCD, in the compression stroke) may be used instead of the pressure ratio $P_m/P_t$ for determining the charging efficiency $C_e$ for the same effect.

Although the operation of the air-fuel ratio control system in controlling the air-fuel ratio while the engine is in an accelerating mode has been explained by way of example, the air-fuel ratio control system carries out a procedure similar to that explained above in determining a predictive charging efficiency variation and computing a compensated fuel injection quantity in controlling the air-fuel ratio while the engine is in a decelerating mode.

Thus, the basic fuel injection quantity is determined on the basis of a charging efficiency calculated by using cylinder pressures respectively at two crank angles, the compensation fuel injection quantity is determined on the basis of a predictive charging efficiency variation determined on the basis of a predictive cylinder pressure ratio and a cylinder pressure ratio, the compensated fuel injection quantity is obtained by adding the basic fuel injection quantity and the compensation fuel injection quantity, and the compensated fuel injection quantity of fuel is injected. Therefore, the air-fuel ratio control system of the present invention does no need any air flow meter, and is capable of determining a fuel injection quantity by using the same parameter, i.e., charging efficiency, and by the same computing procedure for both acceleration and deceleration.

Since the air-fuel ratio control system of the present invention determines a compensated fuel injection quantity on the basis of charging efficiency for both acceleration and deceleration, the fuel injection quantity determined by the air-fuel ratio control system of the present invention is free from computing errors attributable to the accumulation of intake air in the surge tank, which is likely to be included in the fuel injection quantity determined by the conventional air-fuel ratio control system employing an air flow meter.

As is apparent from the foregoing description, the air-fuel ratio control system in accordance with the present invention controls air-fuel ratio on the basis of data provided by a cylinder pressure sensor, an intake air temperature sensor and a throttle opening sensor without using an expensive air flow meter.

Furthermore, the air-fuel ratio control system in accordance with the present invention is capable of simply and accurately controlling the fuel injection quantity to supply an air-fuel mixture of an optimum air-fuel ratio to the engine by calculating a basic fuel injection quantity $(T_p)$ by using a charging efficiency $C_e$ calculated on the basis of the cylinder pressure ratio $(P_m/P_t)$ and an intake air temperature (THA) and calculating a compensation fuel injection quantity $(\Delta T_p)$ by using a predictive charging efficiency variation $(\Delta C_e)$ estimated without delay for at least an accelerating mode or a decelerating mode.

Thus, the air-fuel ratio control system in accordance with the present invention is simple in construction and is capable of optimum air-fuel ratio control.

Although the invention has been described in its preferred form with a certain degree of particularity, obviously many changes and variations are possible therein. It is therefore to be understood that the invention may be practiced otherwise than as specifically described herein without departing from the scope and spirit thereof.

What is claimed is:

1. An air-fuel control system for an internal combustion engine, comprising:

a cylinder pressure sensor for detecting a cylinder pressure in a combustion chamber of the internal combustion engine;

a crank angle sensor for detecting a crank angle of a crank associated with the combustion chamber;

a throttle opening sensor for detecting an opening degree of a throttle valve of the internal combustion engine;

an intake air temperature sensor for detecting a temperature of intake air in an intake passage of the internal combustion engine; and a control unit comprising:

pressure data storage means for storing a cylinder pressure represented by a signal provided by the cylinder pressure sensor each time the output signal of the crank angle sensor indicates a predetermined crank angle before a combustion stroke;

computing means for computing a basic fuel injection quantity ($T_p$) by using the stored cylinder pressure and a signal provided by the intake air temperature sensor as parameters, computing a compensation fuel injection quantity ($\Delta T_p$) for at least one of an accelerating mode and a decelerating mode on the basis of a predetermined cylinder pressure variation corresponding to the variation of the output signal of the throttle opening sensor and a engine speed, and adding the basic fuel injection quantity and the compensation fuel injection quantity to determine a compensated fuel injection quantity ($T_p+\Delta T_p$); and control means for controlling a fuel injection valve of the internal combustion engine on the basis of the compensated fuel injection quantity to supply an appropriate air-fuel mixture.

2. An air-fuel ratio control system according to claim 1, wherein the basic fuel injection quantity ($T_p$) is calculated by a formula:

$$T_p=K_i \cdot C_e(1+F_t)+T_s$$

where $C_e$ is a charging efficiency defined by the cylinder pressure, the engine speed and the intake air temperature, $K_i$ is a factor for converting the charging efficiency $C_e$ into a corresponding fuel injection quantity, $F_t$ is a correction factor dependent on a temperature of the coolant of the internal combustion engine represented by an output signal (S2) of a coolant temperature sensor, and $T_s$ is a battery voltage correction factor.

* * * * *